US007828675B2

(12) United States Patent
Hilton

(10) Patent No.: US 7,828,675 B2
(45) **Date of Patent: *Nov. 9, 2010**

(54) PUTTER HEAD

(75) Inventor: Thomas R. Hilton, Cardiff, CA (US)

(73) Assignee: Callaway Golf Company, Carlsbad, CA (US)

( * ) Notice: Subject to any disclaimer, the term of this patent is extended or adjusted under 35 U.S.C. 154(b) by 34 days.

This patent is subject to a terminal disclaimer.

(21) Appl. No.: 12/337,438

(22) Filed: Dec. 17, 2008

(65) Prior Publication Data

US 2009/0170622 A1 Jul. 2, 2009

Related U.S. Application Data

(60) Provisional application No. 61/017,100, filed on Dec. 27, 2007.

(51) Int. Cl.
*A63B 53/04* (2006.01)
*A63B 53/06* (2006.01)

(52) U.S. Cl. ..... 473/340; 473/349

(58) Field of Classification Search ..... 473/324–350
See application file for complete search history.

(56) References Cited

U.S. PATENT DOCUMENTS 4,010,958 A 3/1977 Long
4,688,798 A 8/1987 Pelz
4,793,616 A 12/1988 Fernandez
5,470,068 A 11/1995 Schmidt et al.
5,951,412 A * 9/1999 Rose et al. ..... 473/340
6,086,484 A 7/2000 Uebelhor
6,375,583 B1 4/2002 Solheim
6,485,375 B1 * 11/2002 McKinley ..... 473/245
6,641,487 B1 * 11/2003 Hamburger ..... 473/288
6,796,911 B2 9/2004 Grace
6,896,625 B2 5/2005 Grace
6,929,559 B1 8/2005 Grace
6,929,564 B2 8/2005 Olsavsky et al.
6,958,019 B2 10/2005 Rohrer
6,974,394 B1 12/2005 Tang et al.
7,108,611 B2 * 9/2006 MacIlraith ..... 473/288
7,147,569 B2 * 12/2006 Tang et al. ..... 473/249
7,169,061 B2 * 1/2007 Hou ..... 473/341
7,244,191 B2 7/2007 Tang et al.
7,455,599 B2 * 11/2008 Jones ..... 473/340
7,491,131 B2 * 2/2009 Vinton ..... 473/251
7,540,810 B2 * 6/2009 Hettinger et al. ..... 473/331
2006/0148585 A1 * 7/2006 Vinton ..... 473/340

* cited by examiner

*Primary Examiner*—Alvin A Hunter
(74) *Attorney, Agent, or Firm*—Michael A. Catania; Elaine H. Lo

(57) ABSTRACT

A putter-type club head (20) having a main body (25) and a removable aft member (30) is disclosed herein. The putter-type club head (20) has a main body (25) that is preferably composed of an aluminum alloy. The removable aft member (30) is preferably composed of stainless steel and preferably has a fang-like shape.

2 Claims, 3 Drawing Sheets

PUTTER HEAD

CROSS REFERENCES TO RELATED APPLICATIONS

The Present Application claims priority to U.S. Provisional Patent Application No. 61/017,100, filed on Dec. 27, 2007.

STATEMENT REGARDING FEDERALLY SPONSORED RESEARCH OR DEVELOPMENT

Not Applicable

BACKGROUND OF THE INVENTION

1. Field of the Invention

The present invention relates to a putter-type club head. More specifically, the present invention relates to a putter-type club head having a removable aft member.

2. Description of the Related Art

The golf industry has been inventing putters that make the game of golf easier for the high handicap player. One such putter is disclosed in U.S. Pat. No. 4,688,798 to David Pelz. The Pelz patent discloses a putter with an alignment means to assist a golfer in aiming a golf ball toward a hole during putting. The Pelz patent discloses using two or three golf ball shaped indicators as the alignment means. The golf ball shaped indicators may be circles, hemispheres, or complete spheres. The Pelz patent discloses positioning the indicators along a line extending rearward from the center of percussion.

Another patent that discloses an alignment means is U.S. Pat. No. 4,659,083 to Szczepanski. The Szczepanski patent discloses a group of lines that converge toward the center of the face of the putter.

Yet another patent that discloses an alignment means is Great Britain Patent Application Number 4,659,083 to Lilley. The Lilley patent also discloses a group of lines that converge toward the center of the face of a putter.

Another example is Schmidt et al., U.S. Pat. No. 5,470,068, for a Golf Putter With Dished Bottom Surfaces which discloses a putter composed of a single cast material and having a hollow interior.

Another example is Uebelhor, U.S. Pat. No. 6,086,484, which was filed on Mar. 20, 1998 for a Golf Putter Head. Uebelhor discloses a putter head with a U-shaped body and a block within the middle. The block has a lower specific gravity than the U-shaped body.

Yet another example is Rose et al., U.S. Pat. No. 5,951,412 originally filed in January of 1996 for a Golf Club, Particularly A Putter. The Rose patent discloses a center portion composed of a light metal material and the heel and toe portions composed of heavier metals. The metals are forged or cast to create the putter head.

Another example is Fernandez, U.S. Pat. No. 4,793,616 for a Golf Club, which was originally filed in 1984, discloses a lightweight composite material molded to a hard, high density material for distribution of mass. Fernandez discloses a composite shell with a high density insert composed of tungsten or some other high density material.

Although these inventions have provided new and improved putters for making the game of golf more enjoyable for high handicap players, the prior art has not optimized a putter by making it more forgiving and assisting in alignment.

BRIEF SUMMARY OF THE INVENTION

One aspect of the present invention is a putter-type club head having a main body and a removable aft member. The main body has a face portion, a crown portion, and a sole portion. The removable aft member is attached to the main body with fasteners. The removable aft member preferably has a central mass portion, a heel arc member extending outward from the central mass portion and a toe arc member extending outward from the central mass member.

Another aspect of the present invention is putter-type club head having a main body and a fang-like removable aft member. The main body has a face portion, a crown portion, and a sole portion. The fang-like removable aft member is attached to the main body with fasteners.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
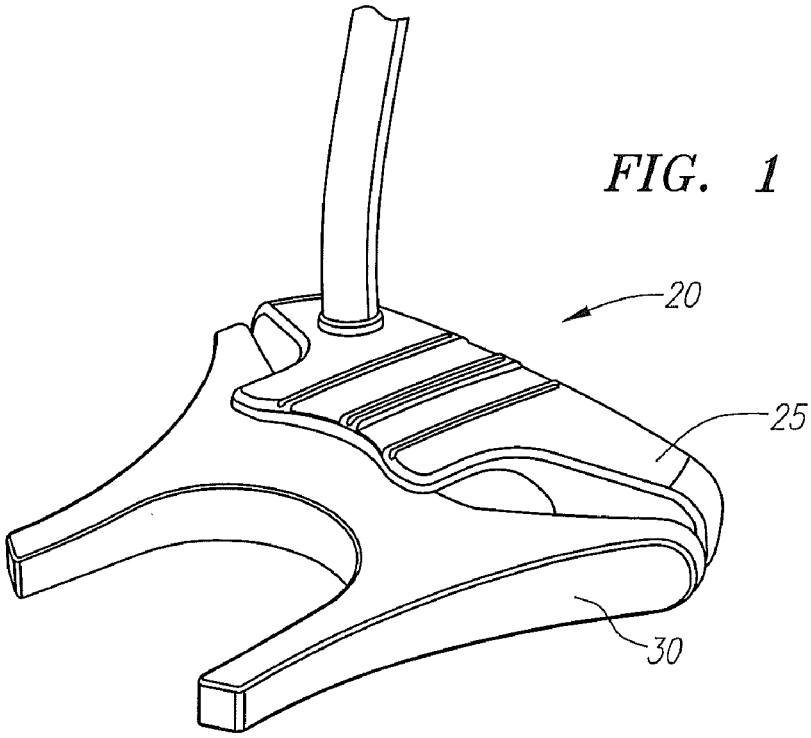
FIG. 1 is a top rear perspective of a preferred embodiment of a putter-type club head of the present invention.
Figure 2:
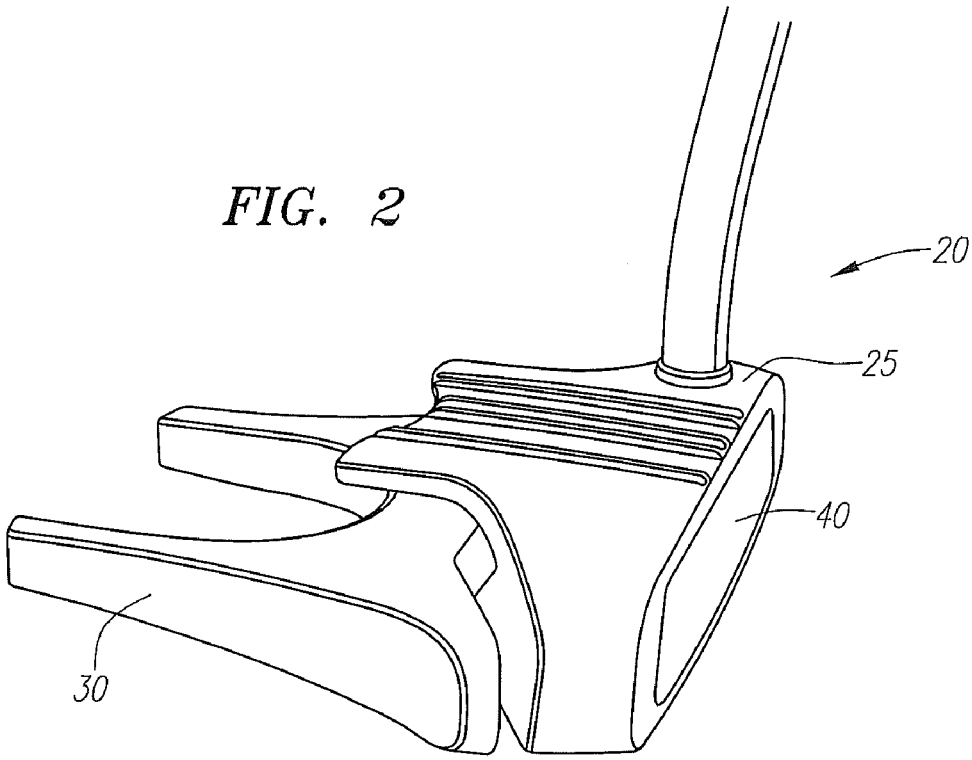
FIG. 2 is a top side perspective of a preferred embodiment of a putter-type club head of the present invention.
Figure 3:
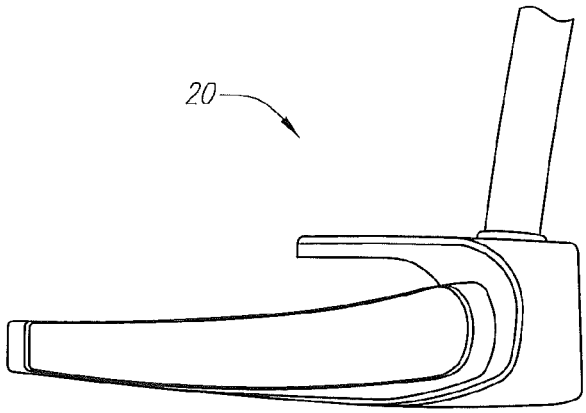
FIG. 3 is a side view of a preferred embodiment of a putter-type club head of the present invention.
Figure 4:
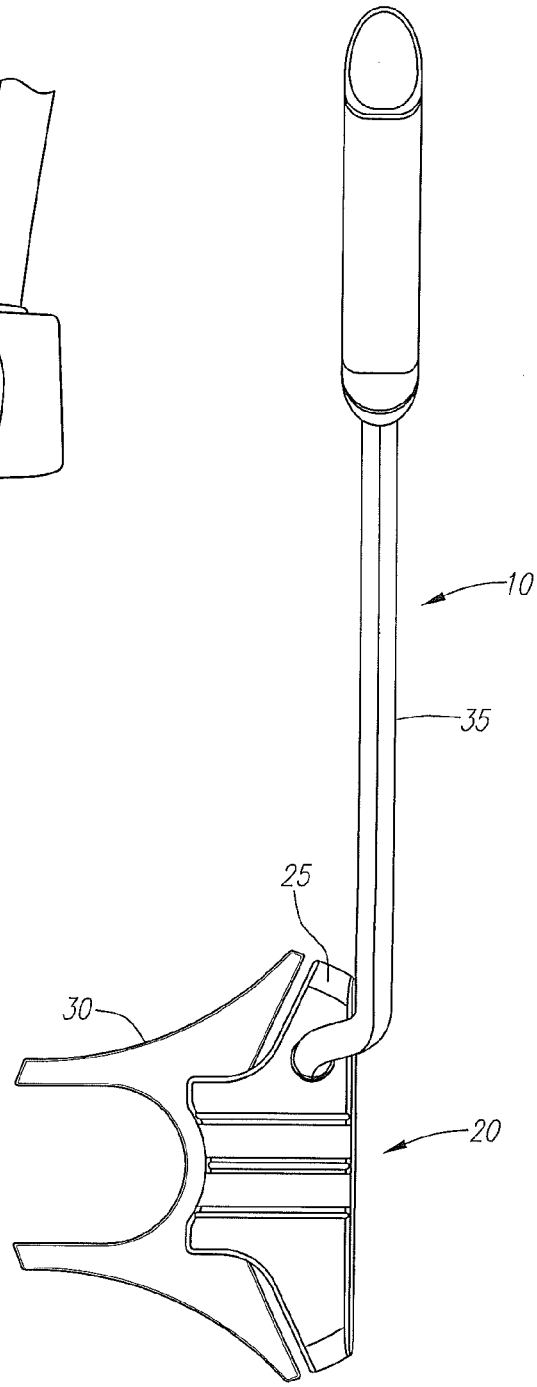
FIG. 4 is a top plan view of a preferred embodiment of a putter-type club of the present invention.
Figure 5:
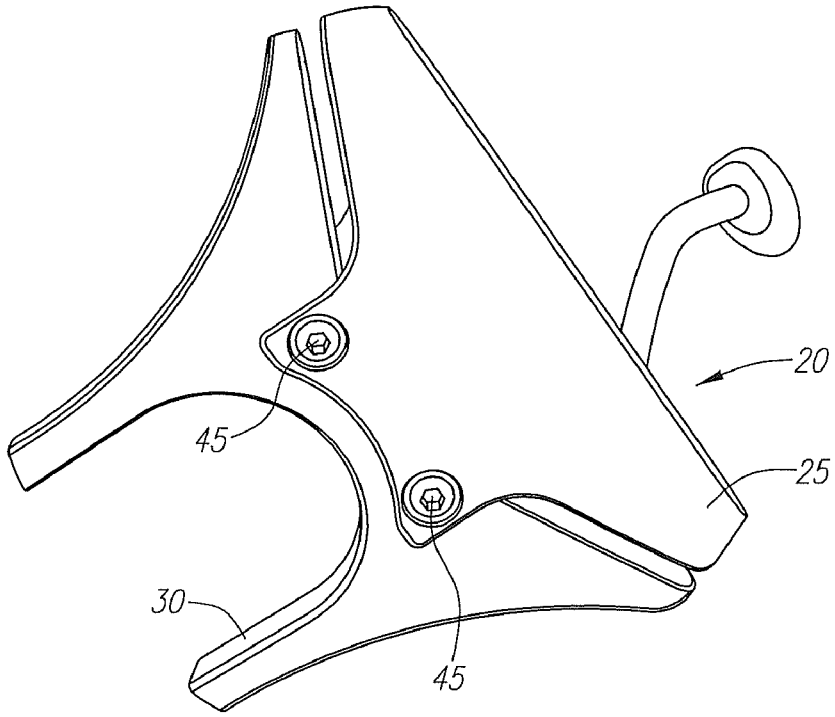
FIG. 5 is a bottom view of a preferred embodiment of a putter-type club head of the present invention.
Figure 6:
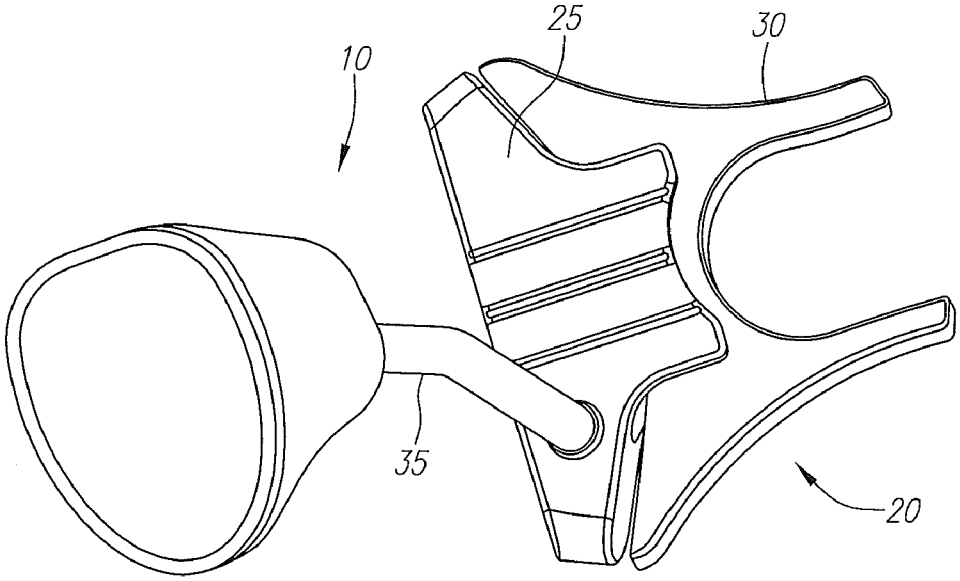
FIG. 6 is a top perspective view of a preferred embodiment of a putter-type club of the present invention.

As shown in FIGS. 1-6, a putter-type club head of the present invention is generally designated 20. A golf club utilizing the putter-type club head 20 is generally designated 10. The club head 20 preferably includes a main body 25 and a removable aft-member 30. The removable aft member 30 preferably has a fang-like shape. In a preferred embodiment, the main body 25 is composed of a material having a density ranging from 0.90 g/cm$^3$ to 6.0 g/cm$^3$. A preferred metal for the main body 25 is an aluminum alloy. Alternative materials for the main body 25 include aluminum, titanium, titanium alloys, magnesium, magnesium alloys, and the like. The main body 25 is preferably formed as a single cast structure using known investment casting techniques. However, those skilled in the pertinent art will recognize that alternative forming techniques such as milling, welding forged or formed pieces, and the like may be utilized without departing from the scope and spirit of the present invention.

The main body 25 preferably weighs from 70 grams to 300 grams, more preferably from 100 grams to 200 grams, even more preferably from 120 grams to 150 grams and most preferably 130 grams.

The removable aft-member 30 is preferably composed of a material that has a density greater than the density of the material of the main body 25. In a preferred embodiment, the removable aft-member 30 is composed of a material having a density ranging from 6.0 g/cm$^3$ to 20.0 g/cm$^3$, and more preferably from 7.0 g/cm$^3$ to 10.0 g/cm$^3$. In a preferred embodiment, the removable aft-member 30 is composed of stainless steel. In alternative embodiments, the removable aft-member 30 is composed of zinc, brass, copper, gold, silver, tungsten, tungsten-based alloys, iron-based alloys, and copper-based alloys.

The removable aft-member 30 preferably weighs from 80 grams to 300 grams, more preferably from 150 grams to 250 grams, and most preferably 240 grams. There is preferably a 2-to-1 mass ratio between the removable aft-member 30 and the main body 25.

The putter-type club head 20 preferably has a mass ranging from 250 grams to 500 grams, more preferably from 300 grams to 400 grams, and most preferably 340 grams.

In a preferred embodiment, the main body 25 has a face portion 40, a crown portion and a sole portion. The face portion 24, the crown portion 26, the sole portion 28, the column portion 30 and the peripheral mass belt 23 define a central aperture 32 that extends through the body 22.

The putter-type club head 20 has a width W' that extends from a heel end to a toe end that preferably ranges from 3.0 inches to 6.0 inches, more preferably from 4.5 inches to 5.5 inches, and most preferably 5.22 inches.

In a preferred embodiment, a crown portion has an alignment means such as circular inserts. Each of the circular inserts are preferably composed of a thermosetting polyurethane material such as described in U.S. Pat. No. 6,273,831, entitled Golf Club Head with A Polymer Insert, assigned to Callaway Golf (the assignee of the Present Application), which is hereby incorporated by reference in its entirety. Alternatively, each of the circular inserts may be composed of a thermoplastic polyurethane. Each of the circular inserts is preferably colored white, through painting or doping of the polyurethane with coloring agents, and each circular insert preferably has a texture of a golf ball cover. Each of the circular inserts preferably has a diameter ranging from 1.62 inches to 1.70 inches, and most preferably 1.68 inches.

Alternative alignment means are disclosed in U.S. Pat. No. 4,688,798, entitled Golf Club And Head Including Alignment Indicators, assigned to the Callaway Golf (the assignee of the Present Application), which pertinent parts are hereby incorporated by reference. As disclosed in U.S. Pat. No. 4,688,798, the alignment means assists a golfer in properly aiming a golf ball toward a hole when putting. Alternative alignment means, including a large white strip may be utilized in the present invention.

The face portion 40 preferably has a thickness ranging from 0.10 inch to 0.50 inch, more preferably 0.20 inch to 0.35 inch. Preferably, an external surface of the face preferably has a face recess, not shown, therein with a face insert disposed therein such as disclosed in U.S. Pat. No. 6,238,302, entitled A Golf Club Head With An Insert Having Integral Tabs, assigned to Callaway Golf (the assignee of the Present Application), which is hereby incorporated by reference in its entirety. As disclosed in U.S. Pat. No. 6,238,302, the face insert is preferably composed of a thermosetting polyurethane material and is preferably colored white.

The putter-type club head 20 preferably has a length, L, from the face portion 40 to the rearward most end of the removable aft member 30, preferably ranging from 3.0 inches to 6.0 inches, more preferably from 4.5 inches to 5.5 inches, and most preferably 5.07 inches. In one alternative embodiment, the putter-type club head 20 has a length, L, that is equal to the width, W'.

The putter-type club head 20 preferably has a moment of inertia about the Izz axis through the center of gravity ranging from 3750 g-cm$^2$ to 4200 g-cm$^2$, and more preferably 3950 g-cm$^2$ to 4100 g-cm$^2$. The Izz axis extends from the sole to the crown.

The removable aft member 30 allows for the mass of the club head 20 to be extended outward from the center of gravity to increase the moment of inertia without adding more mass to the club head 20.

The removable aft member 30 allows for interchangeability between the main body 25 and the removable aft member 30. Preferably, fasteners 45 are inserted through apertures in both the main body 25 and the removable aft member 30 to secure each other together. A urethane vibration layer 50 is placed between the main body 25 and the removable aft member 30 to pr event unwanted vibrations and to eliminate the need for bonding agents. Several removable aft members 30 may have a ball scoop for picking up a golf ball 21 without the need to bend down.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A putter-type club head comprising:

a main body having a sole portion and composed of an aluminum alloy material and having a density ranging from 0.90 g/cm$^3$ to 6.0 g/cm$^3$ and a mass ranging from 120 grams to 150 grams;

a removable aft member having a heel arm and a toe arm, wherein the removable aft member is composed of a stainless steel material having a density ranging from 7.00 g/cm$^3$ to 10.0 g/cm$^3$, and a mass ranging from 150 grams to 250 grams; and means for removably attaching the main body to the removable aft member;

wherein the removable aft member ranges from 20 to 50 volume percent of the putter-type club head and ranges from 60 to 80 weight percent of the putter-type club head, and wherein the putter-type club head has a mass ranging from 300 grams to 400 grams;

wherein the removable aft member only contacts a sole portion of the main body.

2. A putter-type club head comprising:

a main body composed of an aluminum material having a density ranging from 2.0 g/cm$^3$ to 3.0 g/cm$^3$, a body having a face portion, a crown portion, and a sole portion, the crown portion extending rearward from the face portion, the sole portion extending rearward from face portion, the crown portion having an alignment means, wherein the main body has a mass ranging from 120 grams to 150 grams; and a removable aft member attached to the main body, the removable aft member having a central mass portion, a heel arm extending outward from the central mass portion and a toe arm extending outward from the central mass member, the removable aft member composed of a material having a density ranging from 6.0 g/cm$^3$ to 20.0 g/cm$^3$, wherein the removable aft member has a mass ranging from 150 grams to 250 grams;

wherein the crown portion partially covers the removable aft member.

* * * * *